US006952188B2

(12) United States Patent
Noro et al.

(10) Patent No.: US 6,952,188 B2
(45) Date of Patent: Oct. 4, 2005

(54) SATELLITE SIGNAL RECEIVING ANTENNA APPARATUS

(75) Inventors: Junichi Noro, Akita (JP); Kumeo Sasaki, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 41 days.

(21) Appl. No.: 10/785,940

(22) Filed: Feb. 26, 2004

(65) Prior Publication Data

US 2004/0263397 A1 Dec. 30, 2004

(30) Foreign Application Priority Data

Jun. 30, 2003 (JP) ..... P. 2003-186033

(51) Int. Cl.[7] ..... H01Q 1/24
(52) U.S. Cl. ..... 343/702; 343/873
(58) Field of Search ..... 343/702, 895, 343/806, 903, 873; H01Q 1/24

(56) References Cited

U.S. PATENT DOCUMENTS 6,329,961 B1 * 12/2001 Mandai et al. ..... 343/873
6,525,693 B2 * 2/2003 Ugge' ..... 343/713

FOREIGN PATENT DOCUMENTS

JP 2003-78343 3/2003

* cited by examiner

*Primary Examiner*—Don Wong
*Assistant Examiner*—Binh Van Ho
(74) *Attorney, Agent, or Firm*—Whitham, Curtis & Christofferson, PC

(57) ABSTRACT

To assemble two kinds of antenna elements symmetrical with each other by only changing the direction of folding to bend an antenna portion and considerably reduce fabrication cost. A satellite signal receiving antenna apparatus of the invention is characterized in a satellite signal receiving antenna apparatus including a first metal plate as a grounding electrode, a second metal plate constituted by being arranged opposedly to the first metal plate and an antenna element arranged between the first metal plate and the second metal plate for receiving a circularly polarized radio wave. Each of the antenna elements comprises a metal line for receiving the radio wave and an attaching member made of a plastic for supporting the metal line. The attaching member includes an inserting hole inserted with a base end portion of the metal line folded to bend vertically and a metal line inserting groove for supporting at least a portion of an antenna portion extended in a horizontal direction of the metal line, and the metal line inserting groove is formed to correspond to either of the metal lines folded to bend symmetrically in a left and right direction.

9 Claims, 4 Drawing Sheets

SATELLITE SIGNAL RECEIVING ANTENNA APPARATUS

BACKGROUND OF THE INVENTION

1. Field of the Invention

The present invention relates to a satellite signal receiving antenna apparatus for receiving radio wave from an artificial satellite, particularly relates to a satellite signal receiving antenna apparatus for receiving circularly polarized radio wave as in satellite radio broadcast.

2. Description of the Related Art

Conventionally, as an antenna for receiving radio wave from an artificial satellite, for example, a GPS receiving antenna for receiving radio wave from a GPS (Global Positioning System) satellite is known and a so-to-speak patch antenna is used therefor. A patch antenna is provided with a grounding electrode formed by a conductive material on one principal face of a ceramic board constituting an insulating member and provided with a receiving electrode at other principal face of the ceramic board for outputting a received signal to an outside circuit by a feeding pin.

In contrast thereto, in recent years, there has been promoted to provide radio broadcast or the like by circularly polarized radio wave transmitted from an artificial satellite and when such a radio broadcast is received, a so-to-speak satellite radio broadcast receiving antenna is used (refer to, for example, JP-A-2003-78343).

As shown by FIG. 6, a satellite radio broadcast receiving antenna is provided with a first metal plate 21 as a grounding electrode, a second metal plate 22 constituted by being arranged to be opposed to the first metal plate 21 to separate therefrom by a predetermined interval, and a pair of inverse-F shape antennas 23 arranged to dispose in a space constituted between the first metal plate 21 and the second metal plate 22.

The first metal plate 21 is formed in a shape of a rectangular flat plate by a metal material and attached to a lower cover 24. Further, the second metal plate 22 is formed by a metal material and attached to an upper cover 25. Further, there is constituted a structure of containing the respective portions at an inner space of a cover portion 26 constituted by the lower cover 24 and the upper cover 25.

Further, the inverse-F shape antenna 23 is formed in a wire-like shape by a material having conductivity of, for example, a metal or the like and is supported by an attaching member 28 formed by, for example, a resin material or the like above a principal face of the first metal plate 21 in a state of being separated from the first metal plate 21.

Meanwhile, the above-described satellite radio broadcast receiving antenna is arranged with the pair of inverse-F shape antennas 23 such that antenna portions thereof in a wire-like shape extended horizontally are orthogonal to each other in order to achieve an excellent receiving characteristic with regard to, for example, left and right circularly polarized radio waves. The pair of inverse-F shape antennas 23 are attached with the antenna portions in the wire-like shape symmetrically with each other and therefore, in assembling, two kinds of the inverse-F shape antennas 23 symmetrical with each other are needed.

In a prior art, according to the inverse-F shape antenna 23, as shown by, for example, FIG. 7, the antenna portion 31 in the wire-like shape and the attaching member 28 made of a plastic are integrally molded by insert molding, however, when the insert molding is adopted, an increase in cost is brought about. Particularly, when there are prepared two kinds of the inverse-F shape antennas 23 symmetrical with each other are prepared in correspondence with left and right circularly polarized radio waves, two kinds of insert molding dies or the like are needed in correspondence with the respective shapes to bring about a further increase in fabrication cost.

SUMMARY OF THE INVENTION

The invention has been proposed in view of such an actual situation of the prior art and it is an object thereof to provide a satellite signal receiving antenna apparatus capable of assembling two kinds of antenna elements symmetrical with each other by only changing the direction of folding to bend an antenna portion and capable of considerably reducing fabrication cost.

In order to achieve the above-described object, a satellite signal receiving antenna apparatus of the invention is characterized in a satellite signal receiving antenna apparatus including a first metal plate as a grounding electrode, a second metal plate constituted by being arranged opposedly to the first metal plate and an antenna element arranged between the first metal plate and the second metal plate for receiving a circularly polarized radio wave, wherein each of the antenna elements comprises a metal line for receiving the radio wave and an attaching member made of a plastic for supporting the metal line, the attaching member includes an inserting hole inserted with a base end portion of the metal line folded to bend vertically and a metal line inserting groove for supporting at least a portion of an antenna portion extended in a horizontal direction of the metal line, and the metal line inserting groove is formed to correspond to either of the metal lines folded to bend symmetrically in a left and right direction.

According to the invention, the antenna element is constituted by a structure of integrating the metal line and the attaching member constituting the antenna portion without depending on insert molding and two kinds of the antenna elements symmetric with each other are constituted by only changing a way of folding to bend the metal line. Therefore, it is not necessary to prepare two kinds of dies for insert molding as in the prior art, further, insert molding per se causing to increase fabrication cost is not needed.

DESCRIPTION OF THE PREFERRED EMBODIMENTS

A detailed explanation will be given of a satellite signal receiving antenna apparatus to which the invention is applied in reference to the drawings as follows.

Figure 1:
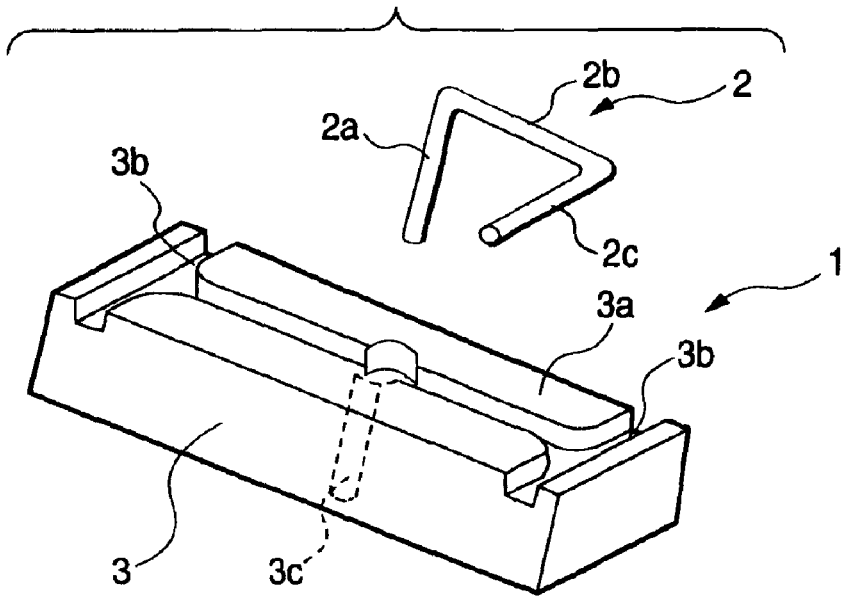
FIG. 1 is a disassembled perspective view showing a constitution of an antenna element used in a satellite signal receiving antenna apparatus of the invention.

FIG. 1 shows a structure of an antenna element used in a satellite signal receiving antenna apparatus of the invention. As illustrated, the antenna element 1 is constituted by an antenna line 2 comprising a metal line and an attaching member 3 made of plastic.

The antenna line 2 is folded to bend in right angle at two portions thereof and is constituted respectively by a base end portion 2*a* folded to bend in a vertical direction, a support portion 2*b* continuous to the base end portion 2*a*, and a receiving portion 2*c* folded to bend in right angle in an in-face direction relative to the support portion 2*b*.

Figure 2:
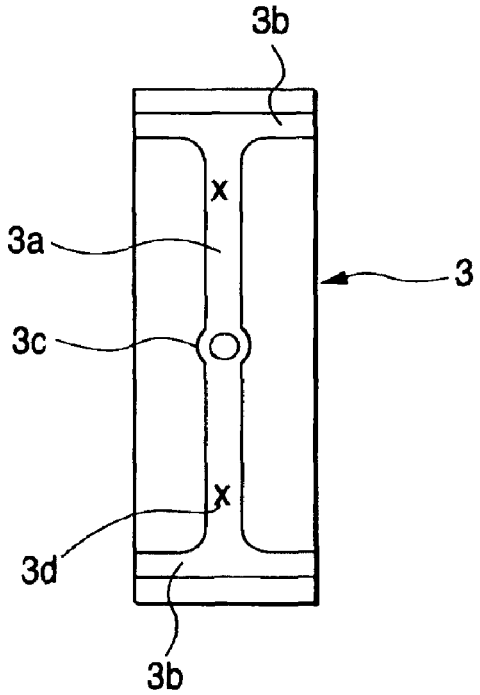
FIG. 2 is a plane view of an attaching member.

The attaching member 3 comprises a molded member of a plastic constituting substantially a shape or a parallelepiped and as shown by FIG. 2, an upper face thereof is formed with a first metal line inserting groove 3*a* inserted with the support portion 2*b* or the antenna line 2 along a longitudinal direction thereof over substantially a total length of the attaching member 3. Further, both end portions of the first metal line inserting groove 3*a* are formed with second metal line inserting grooves 3*b* orthogonal to the first metal line inserting groove 3*a* to traverse the attaching member 3 in a width direction in correspondence with the receiving portion 2*c* of the antenna line 2 folded to bend in right angle. Here the second metal line inserting groove 3*b* is formed over the total width to traverse the attaching member 3 in the width direction to correspond to either of cases when a direction of folding to bend the receiving portion 2*c* is left or right. By forming the metal line inserting grooves 3*a*, 3*b* in this way, either of the antenna lines 2 folded to bend symmetric with each other in the left and right direction can be attached thereto.

Further, a through hole 3*c* vertically penetrating the attaching member 3 is formed at a central portion in a length direction of the first metal line inserting groove 3*a*. The through hole 3 is for inserting the base end portion 2*a* of the antenna line 2 and the base end portion 2*a* of the antenna line 2 inserted thereinto functions as an electrode for taking out a signal of the antenna line 2 by being connected to a board.

Further, small projections 3*d* are formed at a plurality of portions of the first metal line inserting groove 3*a* of the attaching member 3. The small projection 3*d* serves to prevent the support portion 2*b* from being detached simply from the first metal line inserting groove 3*a* by supporting to press the support portion 2*b* of the antenna line 2 when the support portion 2*b* of the antenna line 2 is inserted into the first metal line inserting groove 3*a*. By forming the small projections 3*d*, the antenna line 2 can fixedly be attached to the attaching member 3 without using extra parts.

Figure 3:
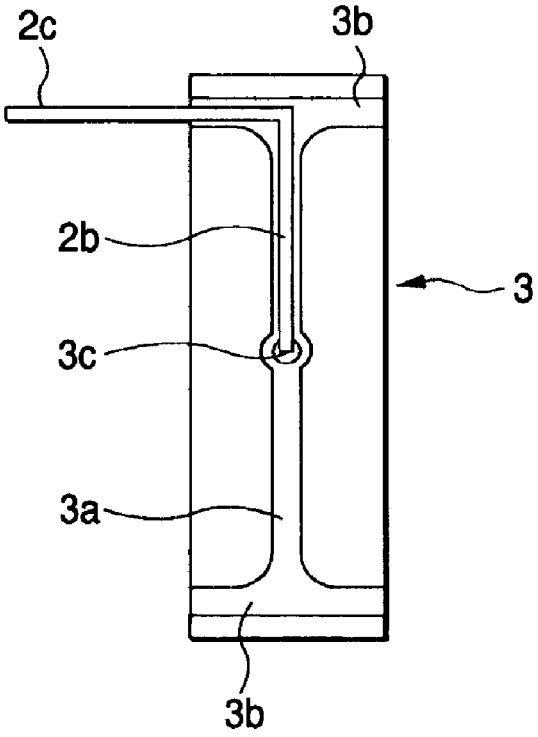
FIG. 3 illustrates plane views showing a state of attaching an antenna line to the attaching member, FIG. 3(*a*) shows an attaching state when the antenna line is folded to bend to the left by 90° and FIG. 3(*b*) shows an attaching state when the antenna line is folded to bend to the right by 90°.
Figure 3:
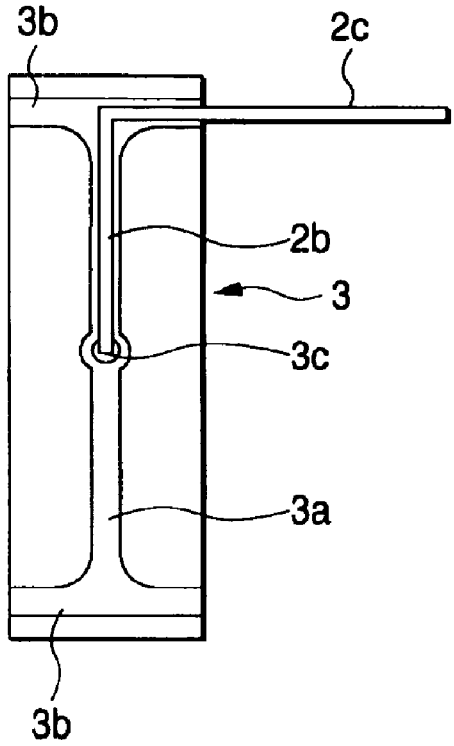

FIG. 3 illustrates views showing a state of attaching the antenna line 2 to the attaching member 3. FIG. 3(*a*) shows a state of attaching the antenna line 2 to the attaching member 3 when the receiving portion 2*c* of the antenna line 2 is folded to bend by 90° to the left relative to the support portion 2*b* and FIG. 3(*b*) shows a state of attaching the antenna line 2 to the attaching member 3 when the receiving portion 2*c* of the antenna line is folded to bend by 90° to the right relative to the support portion 2*b*. Only one kind of the attaching member 3 is used in either case of folding to bend the support portion 2*b* in either direction, for example, it is not necessary to prepare two kinds of dies in correspondence with two kinds of the antenna elements symmetrical with each other in a left and right direction. Further, the antenna elements symmetrical with each other in the left and right direction can be constituted by separately forming and assembling the antenna line 2 and the attaching member 3, that is, by only attaching the antenna line 2 to the metal line inserting grooves 3*a*, 3*b* and the through hole 3*c* of the attaching member 3 and the molding requiring fabrication cost as in insert molding is not needed.

Figure 4:
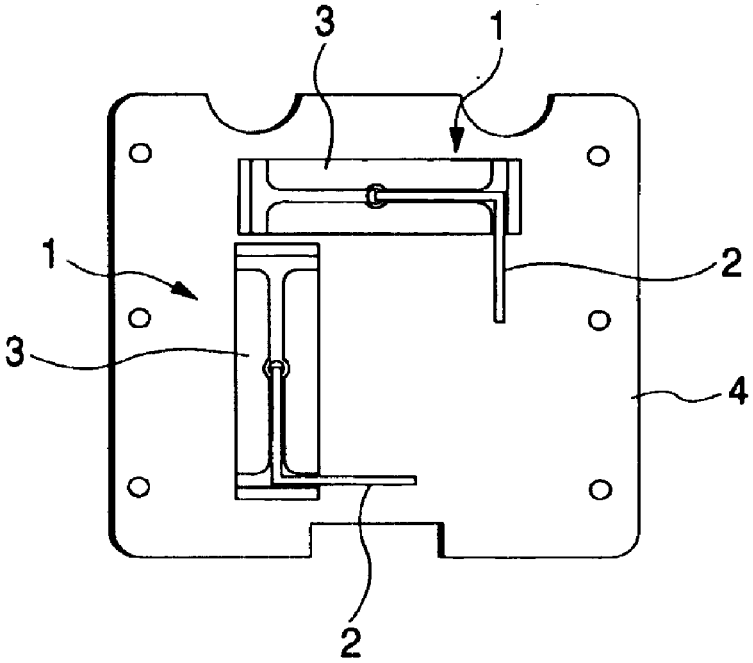
FIG. 4 is a plane view showing a state of attaching the antenna element to a metal plate.

FIG. 4 shows a state of attaching the respective antenna elements 1 to a metal plate 4. The metal plate 4 is mounted with two kinds of the antenna elements 1 to constitute the antenna lines 2 in the symmetrical shapes in correspondence with left and right circularly polarized waves.

The metal plate 4 is provided with a function as a grounding electrode, arranged with the second metal plate to be opposed to the metal plate 4 and separated therefrom by a predetermined interval although illustration thereof is omitted, and the antenna elements 1 are arranged to dispose at a space constituted between the metal plates.

The respective metal plates are formed in a shape of a rectangular flat plate by a metal material and are respectively attached to a lower cover or an upper cover. Further, there is constructed a structure of containing the respective portions in an inner space constituted by the lower cover and the upper cover.

Therefore, according to the antenna apparatus having the above-described structure, the antenna line 2 of the antenna element 1 is supported by the attaching member 3 above a principal face of the metal plate 4 in a state of being separated from the metal plate 4.

Meanwhile, when the antenna element 1 is attached to the metal plate 4, it is general to attach the antenna element 1 and the metal plate 4 by welding in the prior art. However, in the case of attaching by welding, an expensive welder is needed to bring about an increase in fabrication cost. Hence, as shown by FIG. 5, the attaching member 3 of the antenna element 1 may fixedly be attached to the metal plate 4 by filling the attaching member 3 to fit thereto.

Figure 5:
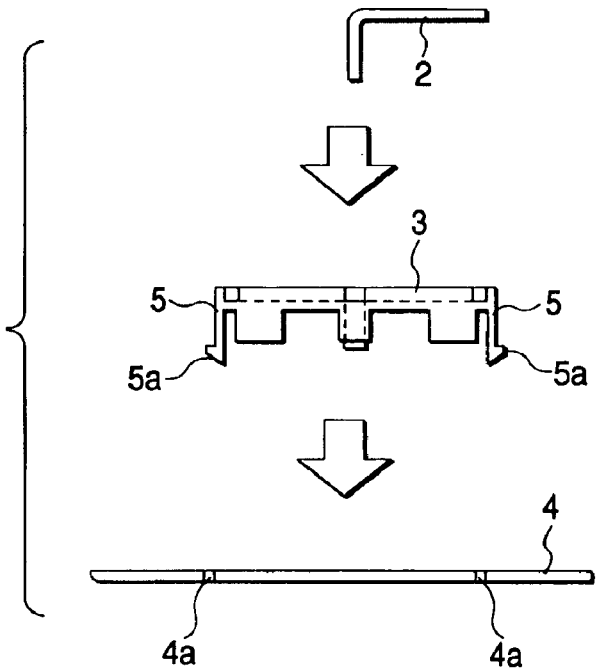
FIG. 5 illustrates views showing an attaching procedure when the attaching member of the antenna element is fixedly attached to the metal plate by filling to fit the attaching member thereto, FIG. 5(*a*) shows a state before attaching, FIG. 5(*b*) shows a state of attaching the attaching member to the metal plate and FIG. 5(*c*) shows a state of pasting a tape, respectively.
Figure 5:
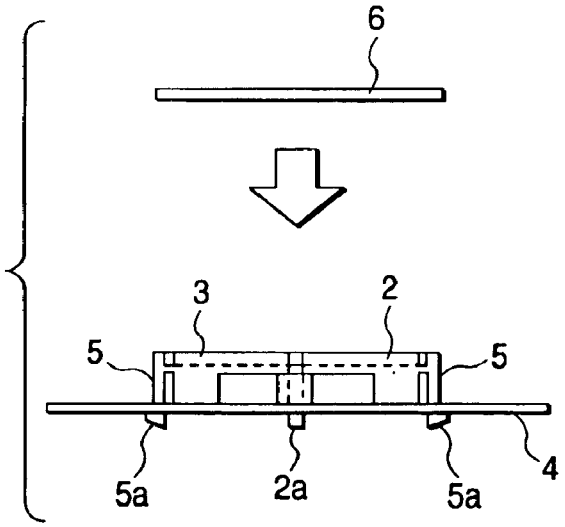
Figure 5:
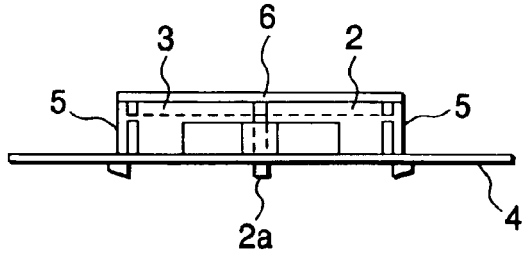
Figure 6:
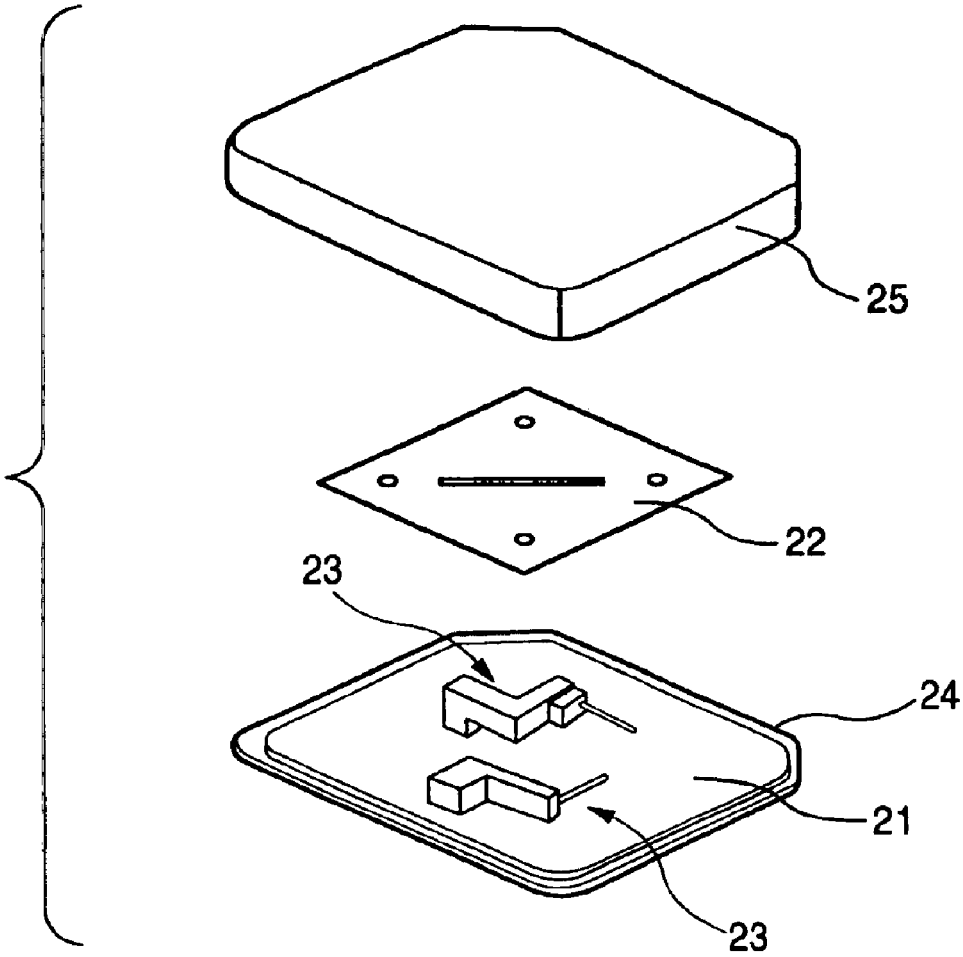
FIG. 6 PRIOR ART
FIG. 6 is a perspective view showing to disassemble an example of a satellite signal receiving antenna apparatus of a prior art.
Figure 7:
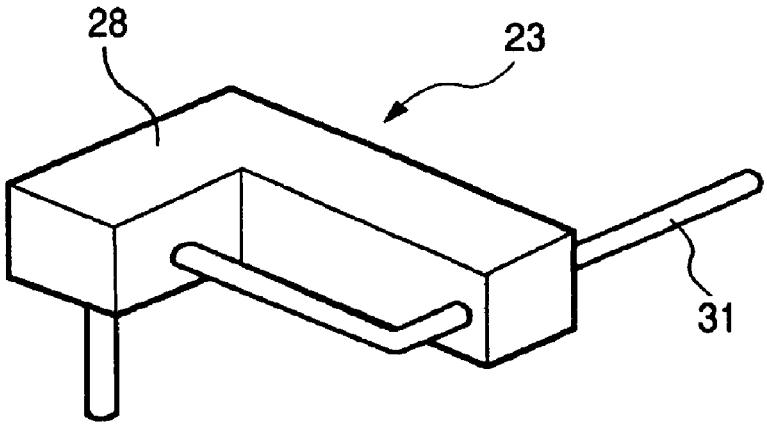
FIG. 7 PRIOR ART
FIG. 7 is a perspective view showing an example of an antenna element of the prior art.

That is, as shown by FIG. 5(*a*), both end portions of the attaching member 3 are provided with fixing pieces 5 having locking claws 5*a*. The fixing piece 5 is a plate-like member of a plastic and can be displaced elastically to some degree.

As shown by FIG. 5(*b*), the locking claws 5*a* are locked by locking holes 4*a* provided at the metal plate 4 to thereby fix the attaching member 3 to the metal plate 4. In the attaching, a technology of welding or the like is not needed at all.

Further, in order to further stabilize a state of attaching the antenna line 2 to the attaching member 3, as shown by FIG. 5(*b*), a tape 6 comprising, for example, a plastic or the like may be pasted thereon in the form of closing the metal line inserting grooves 3*a*, 3*b* of the attaching member 3 inserted with the antenna line 2. FIG. 5(*c*) shows a state of pasting the tape 6 and by pasting the tape 6 in this way, detachment of the antenna line 2 can further be prevented.

As is apparent from the above-described explanation, according to the satellite signal receiving antenna apparatus of the invention, two kinds of the antenna elements symmetric with each other can be integrated by only changing a direction of folding to bend the antenna line, insert molding or two kinds of dies are not needed and therefore, fabrication cost can considerably be reduced.

What is claimed is:

1. An antenna element for receiving a radio wave, comprising;

a conductive wire, having;

a first portion, extending in a first direction, a second portion, continued from the first portion, and extending in a second direction which is perpendicular to the first direction, a third portion, continued from the second portion, and extending in a third direction which is perpendicular to the first direction and the second direction, or extending in a forth direction which is opposite to the third direction, an insulative mount member, having a first face formed with;

a hole, extending in the first direction to receive the first portion of the wire, a first groove, continued from the hole at a first point and extending in the second direction to receive the second portion of the wire, and a second groove, continued from the first groove at a second point so as to have a first section extending in the third direction to receive the third portion of the wire extended in the third direction, and a second section extending in the fourth direction to receive the third portion of the wire extended in the fourth direction.

2. The antenna element according to claim 1, wherein the second groove is extended symmetrically with respect to the second point.

3. The antenna element according to claim 1, wherein the first groove is extended symmetrically with respect to the first point.

4. The antenna element according to claim 1, wherein the insulating mount member has a second face which is perpendicular to the first face, the second groove extend so as to be opened at the second face.

5. The antenna element according to claim 1, further comprising;

a tape member, which covers the wire to retain the wire on the mount member.

6. The antenna element according to claim 1, wherein the wire is detachably integrated with the mount member.

7. The antenna element according to claim 1, wherein a projection is formed in at least one of the first groove and the second groove to retain the wire therein.

8. A antenna apparatus, which includes the antenna element according to claim 1, the apparatus comprising;

a first grounded metal plate;

a second metal plate, which is arranged opposedly to the first metal plate, and wherein the antenna element is arranged between the first metal plate and the second metal plate.

9. The satellite signal receiving antenna apparatus according to claim 7, wherein the mount member comprises a retainer, and the first plate comprises an opening portion to which the retainer is fitted such that the antenna element is retained on the first plate.

* * * * *